US011672315B2

(12) United States Patent
Brandon et al.

(10) Patent No.: US 11,672,315 B2
(45) Date of Patent: Jun. 13, 2023

(54) CONVERTIBLE BAG AND A METHOD FOR OPERATING A CONVERTIBLE BAG

(71) Applicant: Beaudurof Ltd, Ashford (GB)

(72) Inventors: Frances Brandon, Ashford (GB); Jacqueline Gilbert, Ashford (GB)

( * ) Notice: Subject to any disclaimer, the term of this patent is extended or adjusted under 35 U.S.C. 154(b) by 188 days.

(21) Appl. No.: 16/761,240

(22) PCT Filed: Oct. 31, 2018

(86) PCT No.: PCT/EP2018/025274
§ 371 (c)(1),
(2) Date: May 1, 2020

(87) PCT Pub. No.: WO2019/086145
PCT Pub. Date: May 9, 2019

(65) Prior Publication Data

US 2020/0352295 A1 Nov. 12, 2020

(30) Foreign Application Priority Data

Nov. 1, 2017 (GB) ..... 1718108
Jul. 4, 2018 (GB) ..... 1810973

(51) Int. Cl.
*A45C 9/00* (2006.01)
*A45C 3/06* (2006.01)
(Continued)

(52) U.S. Cl.
CPC ..... *A45C 9/00* (2013.01); *A45C 3/06* (2013.01); *A45C 13/30* (2013.01); *A45F 4/02* (2013.01);
(Continued)

(58) Field of Classification Search
CPC ..... A45F 3/02; A45F 3/04; A45F 4/02; A45C 13/26; A45C 3/06; A45C 2009/007
(Continued)

(56) References Cited

U.S. PATENT DOCUMENTS 294,622 A * 3/1884 Honinger ..... A45F 3/02 224/608
432,607 A * 7/1890 Dwyer ..... A45F 3/04 224/604
(Continued)

FOREIGN PATENT DOCUMENTS

CN 205214395 U 5/2016
DE 202012010159 U1 * 4/2013 ..... A45C 13/26
(Continued)

OTHER PUBLICATIONS

Search Report under Section 17 issued in GB Application No. GB1718108.2 dated Aug. 28, 2018, 4 pages.
(Continued)

*Primary Examiner* — Justin M Larson
(74) *Attorney, Agent, or Firm* — RC Trademark Company

(57) ABSTRACT

A convertible bag 10 comprising: a handle 30; and two retractable straps 40, wherein each retractable strap 40 is extendable from the bag and releasably attachable to the handle 30, so as to convert the convertible bag 10 from a handbag configuration in which the bag may be carried using the handle 30, to a backpack configuration in which the bag may be carried using backpack straps formed from the handle 30 and the retractable straps 40, and wherein each retractable strap 40 is releasable from the handle 30 and retractable, so as to convert the convertible bag 10 from the backpack configuration to the handbag configuration.

9 Claims, 15 Drawing Sheets

(51) Int. Cl.
*A45C 13/30* (2006.01)
*A45F 4/02* (2006.01)
*A45C 13/26* (2006.01)

(52) U.S. Cl.
CPC ..... *A45C 13/26* (2013.01); *A45C 2009/007* (2013.01)

(58) Field of Classification Search
USPC ..... 224/578, 579, 580
See application file for complete search history.

(56) References Cited

U.S. PATENT DOCUMENTS 447,669 A * 3/1891 Dwyer ..... A45F 3/04 224/604
1,359,461 A * 11/1920 Luce ..... A45C 13/26 D3/315
1,467,919 A * 9/1923 Blumenthal ..... A45C 3/06 383/18
1,979,978 A * 11/1934 Martin ..... A45C 13/26 383/17
2,960,137 A * 11/1960 Lipsitz ..... A45C 11/38 150/108
3,019,952 A * 2/1962 Brewster ..... A45C 3/00 294/142
3,549,064 A * 12/1970 Wilson ..... B25H 3/023 224/616
3,622,056 A * 11/1971 Droeger ..... A45C 3/00 224/580
3,802,613 A * 4/1974 Droeger ..... A45F 3/04 224/153
3,995,802 A * 12/1976 Johnston ..... A45F 3/04 294/157
4,213,549 A * 7/1980 Hibbard ..... A45C 11/22 224/601
4,273,274 A * 6/1981 Freistadt ..... A45F 3/04 150/108
4,679,671 A * 7/1987 Kobayashi ..... A45F 3/04 190/115
4,687,036 A * 8/1987 Thomas ..... A45C 13/10 224/601
4,887,751 A * 12/1989 Lehman ..... A45F 3/04 190/110
5,072,867 A * 12/1991 Zingale ..... A45F 3/02 206/315.3
6,053,381 A * 4/2000 Fahl ..... A45F 3/047 150/108
6,138,881 A * 10/2000 Paul ..... A45F 3/14 224/645
6,286,461 B1 * 9/2001 Martz ..... A01K 1/0254 119/497
6,299,044 B1 * 10/2001 Klindworth-Garron ..... A45F 3/02 224/616
D458,018 S * 6/2002 Mentken ..... D3/217
8,092,087 B2 * 1/2012 Simhony ..... A45C 15/00 150/108
8,123,092 B2 * 2/2012 Krulik ..... A45C 13/30 150/108
D778,615 S * 2/2017 Georges ..... D3/327
D902,598 S * 11/2020 Chung ..... A45C 13/30 D3/327
2004/0065708 A1 * 4/2004 Amram ..... A45F 3/047 224/579
2016/0120280 A1 5/2016 Dingler et al.
2020/0329839 A1 * 10/2020 Chung ..... A45F 3/042
2020/0352295 A1 * 11/2020 Brandon ..... A45C 13/26
2020/0367624 A1 * 11/2020 Kayam ..... A45F 4/02

FOREIGN PATENT DOCUMENTS

EP 1323362 A2 * 7/2003 ..... A45F 3/047
EP 1323362 A2 7/2003
GB 07368 A * 7/1900
GB 190007368 A 7/1900
GB 2498024 A 7/2013
GB 2498024 A8 * 5/2019 ..... A45C 13/26
JP H0568321 U 9/1993
WO WO-2019086145 A3 * 6/2019 ..... A45C 13/26

OTHER PUBLICATIONS

Notification of Transmittal of the International Search Report and Written Opinion of the International Searching Authority mailed in PCT Application No. PCT/EP2018/025274 dated Apr. 29, 2019, 18 pages.
Notification Concerning Transmittal of the International Preliminary Report on Patentability issued in PCT Application No. PCT/EP2018/025274 dated May 5, 2020, 11 pages.
First Examination Report issued in IN Patent Application No. IN202017022803 dated Jan. 20, 2021, 5 pages.

* cited by examiner

CONVERTIBLE BAG AND A METHOD FOR OPERATING A CONVERTIBLE BAG

The invention relates to a convertible bag and a method of operating a convertible bag. More specifically, the invention relates to a convertible bag that is convertible between a handbag configuration and a backpack configuration.

BACKGROUND

Handbags and shoulder bags are commonly used for transporting personal belongings. In use, a user carries a handbag by its handles, or in the case of shoulder bags they are worn over one of the user's shoulders. The contents in these bags are easily accessible because the user can search for a particular item in the bag without setting the bag down. However, since these bags are carried on one side of the user, they may be uncomfortable to use over an extended period of time. Moreover, their use may cause instability when the user needs to carry a heavy load, or during activities such as cycling.

Some users may opt for backpacks or rucksacks instead. A backpack comprises a pair of shoulder straps and allows the carried load to be spread evenly over the user's shoulders. It therefore eases the stress exerted on each of the user's shoulders, as well as providing better stability. However, carrying a backpack in a crowded space, for example during a peak-hour commute, could be of great inconvenience because the backpack takes up additional footprint. Therefore, some backpacks comprise an additional handle, so as to allow the user to carry the backpack in a manner similar to carrying a handbag if needed.

However, this structure suffers various disadvantages. For example, the additional handle as provided on some backpacks is usually quite short in length and merely sufficient to accommodate a user's palm. This helps to make the handle relatively unobtrusive when it is not in use, but the handle tends to be uncomfortable to use. In addition, the loosened shoulder straps are unsightly and present a trip hazard for others when the backpack is carried by the additional handle.

SUMMARY OF INVENTION

The invention provides a convertible bag, and a method, as defined in the appended independent claims, to which reference should now be made. Preferred or advantageous features of the invention are set out in dependent claims.

The present invention may thus provide a convertible bag comprising a handle and two retractable straps. Each of the two retractable straps is configured to extend from the bag, such as through an aperture in an outer surface of the bag, and to releasably attach to the handle. The two straps may extend through a single, common aperture or through two separate apertures. The aperture(s) may be on a side surface of the bag or in a base surface of the bag. The convertible bag is convertible from a handbag configuration in which the bag may be carried using the handle, to a backpack configuration in which the bag may be carried using backpack straps, by performing the steps of extending each of the two retractable straps through the aperture, or apertures, and releasably attaching each of the two retractable straps to the handle, thus forming backpack straps comprising the handle and the retractable straps. The convertible bag is convertible from the backpack configuration to the handbag configuration by performing the steps of releasing each of the two retractable straps from the handle, and retracting each of the two retractable straps through the aperture, or apertures. When retracted, the straps are preferably hidden from sight, within the bag.

The convertible bag is arranged to convert between a handbag and a backpack configuration so that a user may opt for different carrying styles as required. When the convertible bag is carried by the handle, the retractable straps are retracted into the bag through the aperture and therefore they do not present a trip hazard. The bag also has a clean, elegant appearance as a portion of the retracted straps are advantageously hidden from view. When the bag is carried in the backpack configuration, the handle forms part of the backpack straps and as a result the handle is no longer freely movable. This may advantageously allow a longer and a more comfortable handle to be provided for use when the bag is in its handbag configuration, than is provided in the conventional backpacks that are commonly available. For example, a longer handle may allow the convertible bag (in the handbag configuration) to be carried over one of the user's shoulders as a shoulder bag, which is not feasible using the short carrying handle in the prior art backpacks.

In a preferred embodiment of the invention, the handle comprises two handle portions. One end of each handle portion is secured to the bag, and in the handbag configuration the other ends of the two handle portions are releasably attached to each other to form said handle. In the backpack configuration the two handle portions may be separated from each other, and each of the handle portions releasably attached to a respective one of the retractable straps to form a backpack strap.

Optionally, the steps for converting the convertible bag from the handbag configuration to the backpack configuration may thus comprise a step of detaching the two handle portions from each other. Optionally, the steps for converting the convertible bag from the backpack configuration to the handbag configuration may comprise a step of releasably attaching the two handle portions to each other to form the handle.

In an alternative embodiment, the handle may be continuous, and may not comprise two separate handle portions. In this embodiment, in the backpack configuration, the continuous handle releasably attaches to both of the retractable straps. The handle may either be long so that in the backpack configuration the handle passes over the user's head and across their chest, or it may be short and may sit behind the user's neck in the backpack configuration.

The releasable attachment between the straps and the handle may advantageously allow the retractable straps to be manually attached to or detached from the handle. The releasable attachment may comprise any suitable fastening, such as clasps, buckles, or hoop and loop attachments.

Optionally, each of the handle, the handle portions (if present), and the retractable straps comprises a fastening or clasp for effecting said releasable attachment. The fastenings of the handle portions may be configured to cooperate with each other in the handbag configuration, or with the fastenings of the retractable straps in the backpack configuration. This may advantageously allow the same fastening mechanism to be used universally between the handle or handle portions and the backpack straps.

Optionally, when the convertible bag is converted into the handbag configuration, the retractable straps are securely retracted and are arranged to be hidden within the bag. This arrangement may advantageously both hide the retracted straps to give the bag a clean, elegant appearance and prevent accidental release of the retractable straps from within the bag to form a trip hazard.

Optionally, the convertible bag comprises a retracting means for retracting the retractable straps through the aperture, or apertures, in the bag. For example, the retracting means may be configured to retract or to reel in said straps from outside the bag into a compartment within the bag.

Optionally, the convertible bag further comprises an auxiliary handle configured to cooperate with the handle, such that when the bag is in its handbag configuration it may be carried using both the handle and the auxiliary handle. The auxiliary handle may be provided on an opposite side of the convertible bag to the handle to improve stability.

In a preferred embodiment, in order to retract the retractable straps, an opposite end of each strap may be connected to a respective end of the auxiliary handle and the auxiliary handle may be mounted so that it can be extended from, or retracted towards, the bag. In this way, when converting the bag from the handbag configuration to the backpack configuration, when the retractable straps are pulled away from the aperture(s) in the bag, the opposite ends of the straps may draw (or retract) at least a portion of the auxiliary handle, for example through an auxiliary-handle aperture or apertures (or auxiliary aperture or apertures), into an interior portion of the bag. Similarly, when the bag is converted back to its handbag configuration, drawing the auxiliary handle away from the auxiliary-handle aperture(s) both extends the auxiliary handle and retracts the retractable straps. To achieve this the retractable straps may extend through and be slidable within a passage or passages within the bag from the strap aperture(s) to the auxiliary-handle aperture(s). The auxiliary-handle apertures may be provided on an opposite side of the convertible bag to the strap apertures, such that the two retractable straps may extend through the bag. For example, a first end of each strap may be releasably attachable to the handle, as described above, and a second end of each strap may be fixed to, or comprise a part of, the auxiliary handle.

This arrangement may advantageously ensure that the retractable straps or the auxiliary handle are securely retracted when the bag is carried in the handbag configuration and the backpack configuration respectively. Because the retractable straps are fixed to the auxiliary handle, extending either the retractable straps or the auxiliary handle away from the bag leads to the retraction of the other towards the bag.

Optionally, the auxiliary handle may comprise two auxiliary handle portions releasably attached to each other. Optionally, the steps for converting the convertible bag from the handbag configuration to the backpack configuration may then comprise detaching the two auxiliary handle portions from each other. Optionally the steps for converting the convertible bag from the backpack configuration to the handbag configuration may comprise releasably attaching the two auxiliary handle portions to each other to form the auxiliary handle.

The auxiliary handle may thus be configured to divide into two auxiliary handle portions when the bag is carried in the backpack configuration. This arrangement may not only allow the auxiliary handle to be further retracted into the bag, it may also provide an additional length in the retractable straps. As a result, shorter retractable straps may be used. In addition, this arrangement may advantageously avoid excessive bending in the auxiliary handle as it retracts through the auxiliary-handle aperture(s), and thereby prolonging the useable life of the auxiliary handle.

In an alternative embodiment in which the retractable straps are not connected to an auxiliary handle, the retracting means may comprise a spring-loaded retractor spool or it may comprise any other retracting means such as a winder and a ratchet for retracting each of the two retractable straps through the aperture, or apertures, in the bag. The bag may comprise one such retracting means for each retractable strap, or a single retracting means to retract both straps.

Optionally, the backpack straps are separate to each other in the backpack configuration and when in use, each of the backpack straps may be configured to extend over a user's shoulder. More specially, the backpack straps may be in parallel arrangement so to allow the bag to be loaded on the user's back easily. Thus, if the handle is mounted at an upper portion of the bag, the aperture(s) for the retractable straps may be positioned at a lower portion of the bag, preferably on the same side of the bag as the handle, for example on a base or side or end surface of the bag.

Optionally, each of the retractable straps comprises an adjuster, configured to vary the length of the respective backpack strap in the backpack configuration. The adjusters may be webbing strap adjusters, buckles, winders or any other suitable adjusters.

According to the present invention, there is also provided a method of operating a convertible bag as described above. The method may advantageously comprise the steps of extending each of the two retractable straps from the bag, such as through the aperture, or apertures, in the bag, and releasably attaching each of the two retractable straps to the handle to convert the bag to a backpack configuration. These form backpack straps comprising the handle and the retractable straps. The method may also comprise the steps of releasing each of the two retractable straps from the handle and retracting each of the two retractable straps through the aperture, or apertures, in the bag to convert the bag to a handbag configuration.

According to another embodiment of the present disclosure, there is provided a hooked clasp, for use along with a second hooked clasp in a fastener for releasably securing strap ends to be adjoined, the hooked clasp having a strap attachment means towards a strap end of the hooked clasp and a corresponding hook further from the strap end of the clasp in a longitudinal direction, the hook having a return directed towards the strap end of the clasp and thereby configured such that, when arranged with a corresponding hook on a second hooked clasp in the opposite longitudinal direction, the hook can catch the corresponding hook on the second hooked clasp, the hooked clasp having an orifice, the return and orifice dimensioned such that the return of the hooked clasp can pass into the orifice of the second hooked clasp without deforming the hook before the hook catches the hook on the second hooked clasp, and the return having an inner side comprising a magnet.

According to yet another embodiment, there is provided a fastener for releasably securing strap ends to be adjoined, the fastener comprising a first and a second hooked clasp of the aforementioned embodiment.

LIST OF FIGURES

Embodiments of the invention will now be described, by way of illustration only, with reference to the accompanying figures, in which:

FIGS. 1*a* and 1*b* are perspective views of a convertible bag in a handbag configuration and a backpack configuration, according to a first embodiment of the present invention.

Figure 4A:
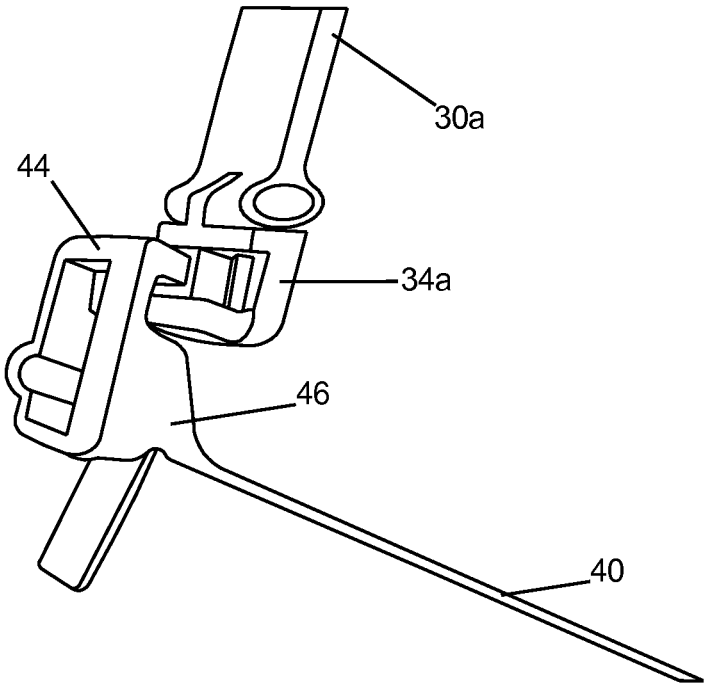
Figure 4B:
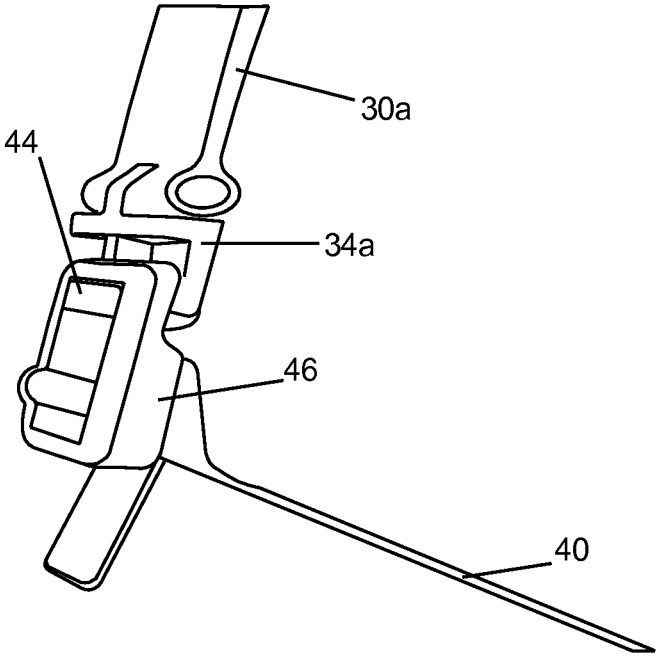

FIGS. 4*a* and 4*b* are perspective views illustrating the engagement between a clasp of a handle portion and a corresponding clasp of a retractable strap.

Figure 5A:
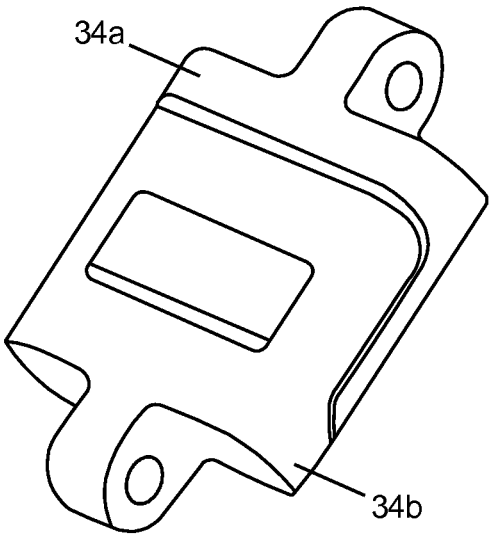
Figure 5B:
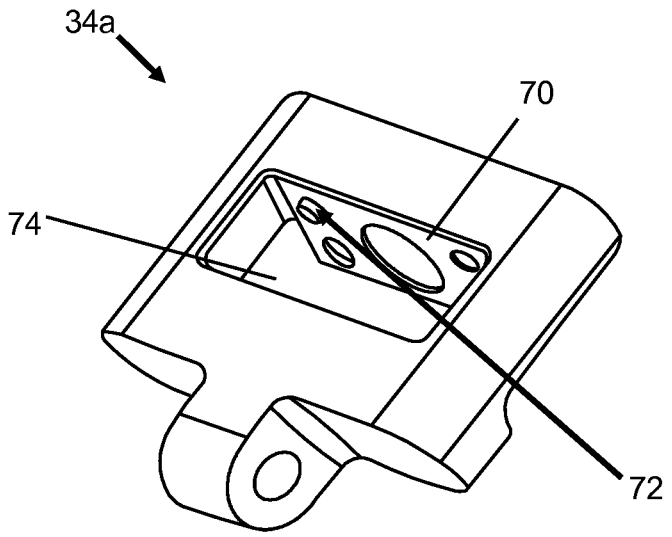
Figure 5B:
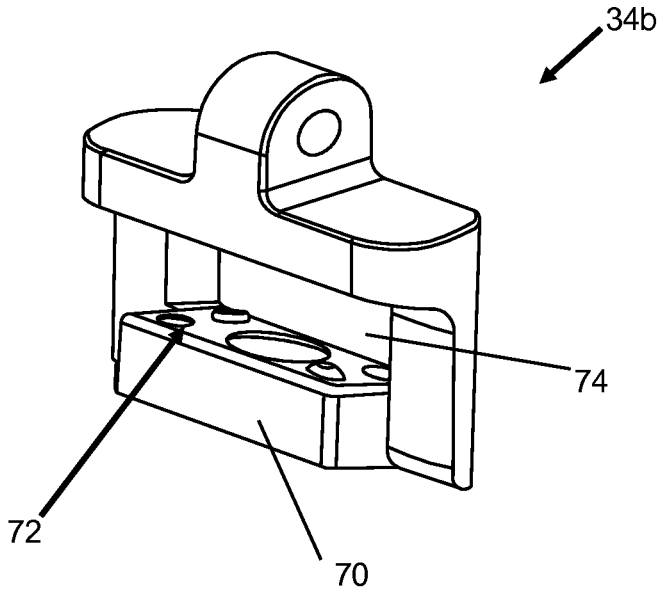

FIGS. 5*a* and 5*b* are detailed illustrations of a clasp mechanism provided in the clasps.

Figure 6A:
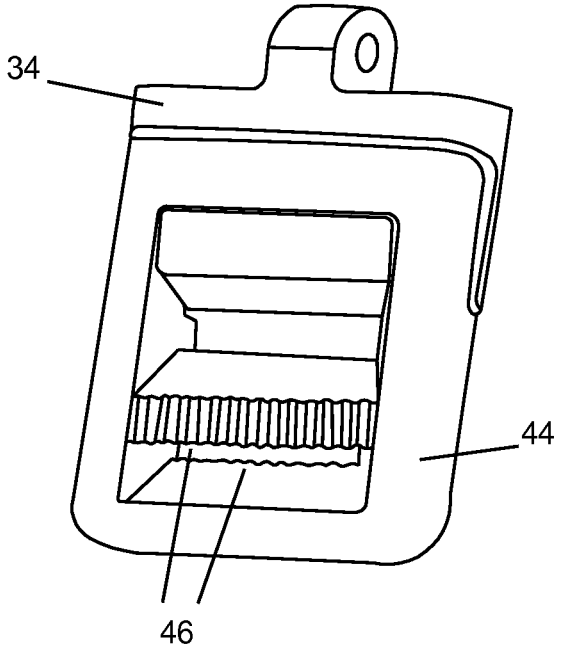
Figure 6B:
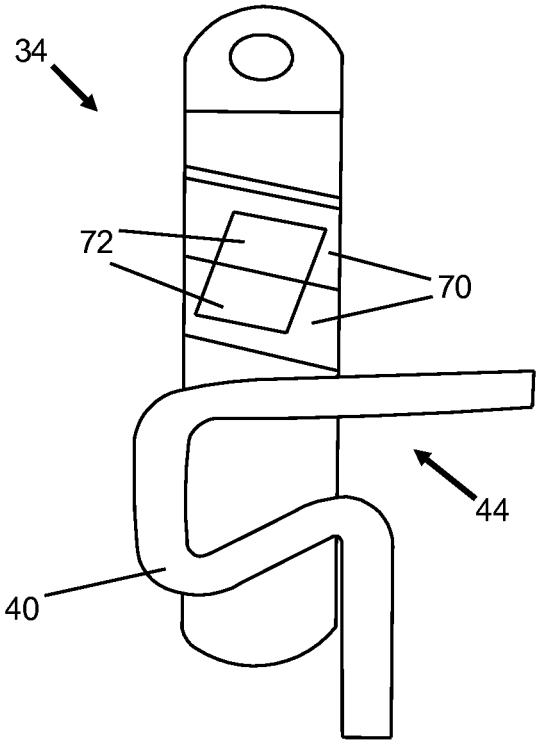

FIGS. 6*a* and 6*b* are detailed illustrations of a length adjustment mechanism in the clasp in FIGS. 4*a* and 4*b*.

Figure 7A:
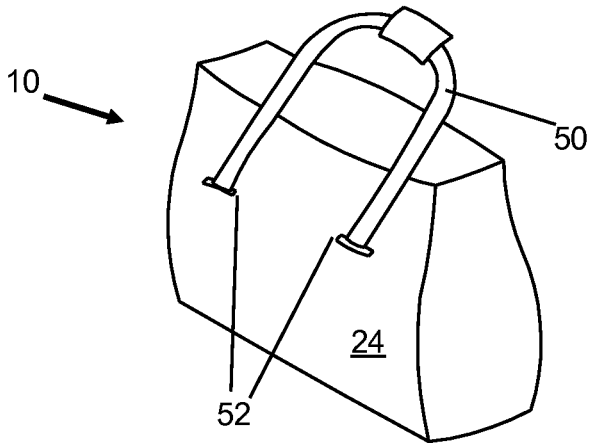
Figure 7B:
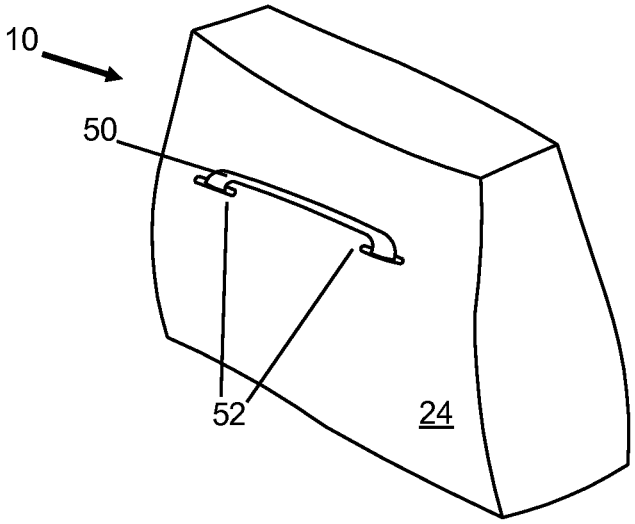

FIGS. 7*a* and 7*b* are perspective views of a convertible bag in a handbag configuration and a backpack configuration, according to a fourth embodiment of the present invention.

Figure 7C:
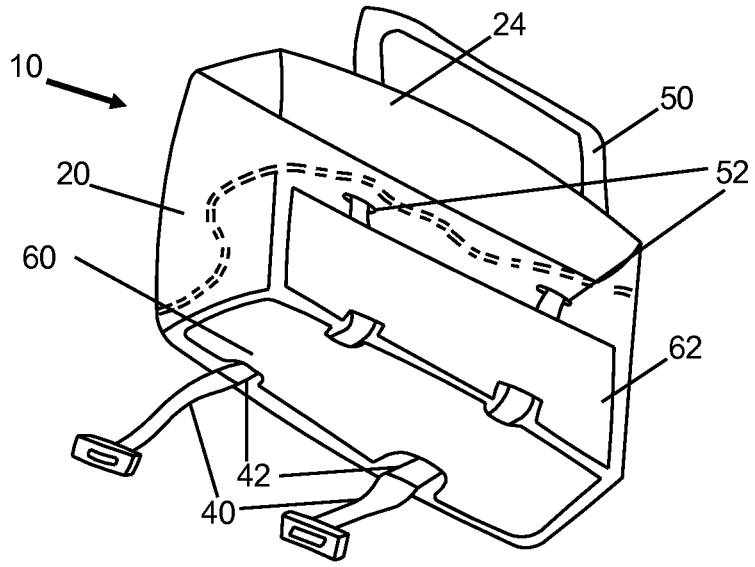
Figure 7D:
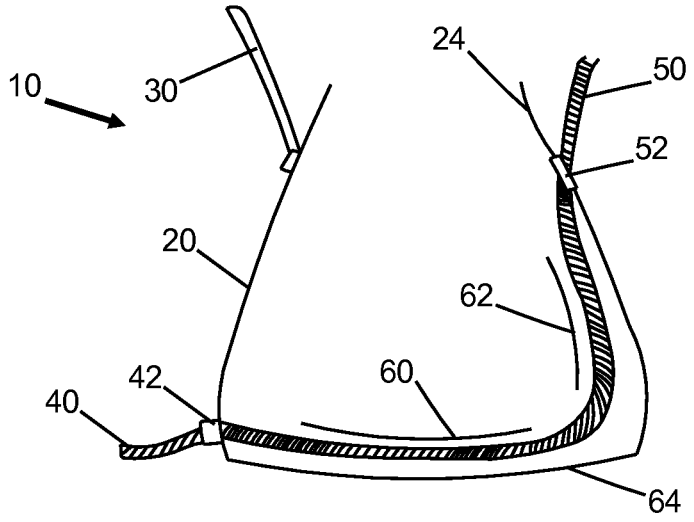

FIGS. 7*c* and 7*d* are respectively cut-away and cross-sectional illustrations of the convertible bag as shown in FIGS. 7*a* and 7*b*.

Figure 8A:
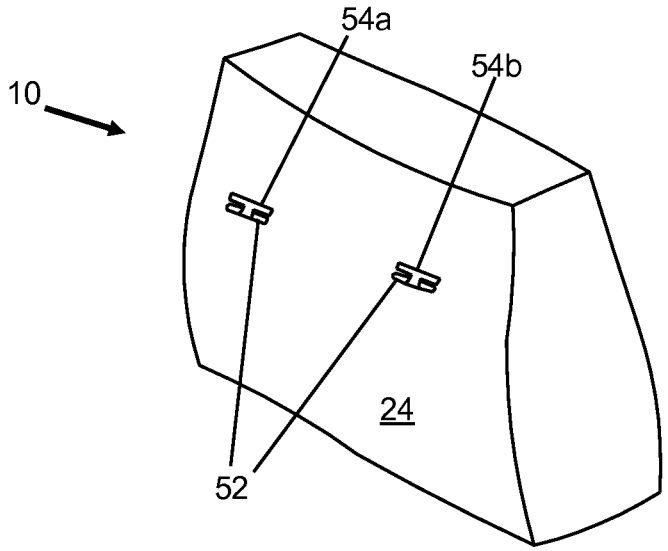
Figure 8B:
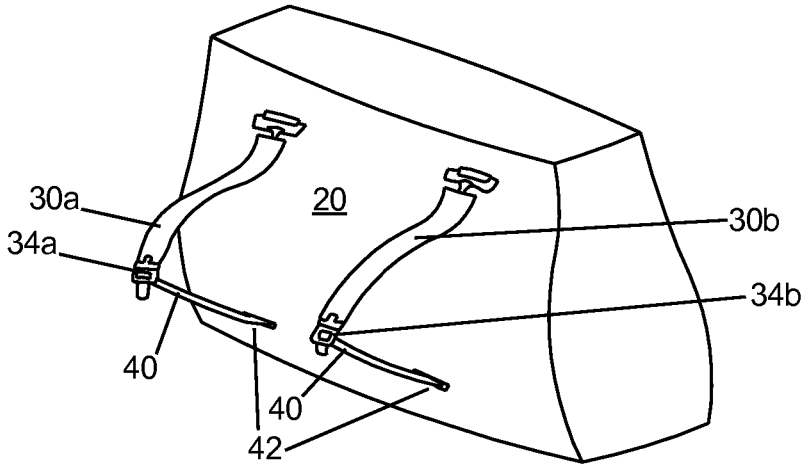

FIGS. 8*a* and 8*b* are perspective views of a convertible bag in a backpack configuration when viewed from opposite (front and rear) sides, according to a fifth embodiment of the present invention.

FIGS. 9*a* to 9*d* are detailed illustrations of an alternative clasp mechanism provided in the clasps.

Figure 10:
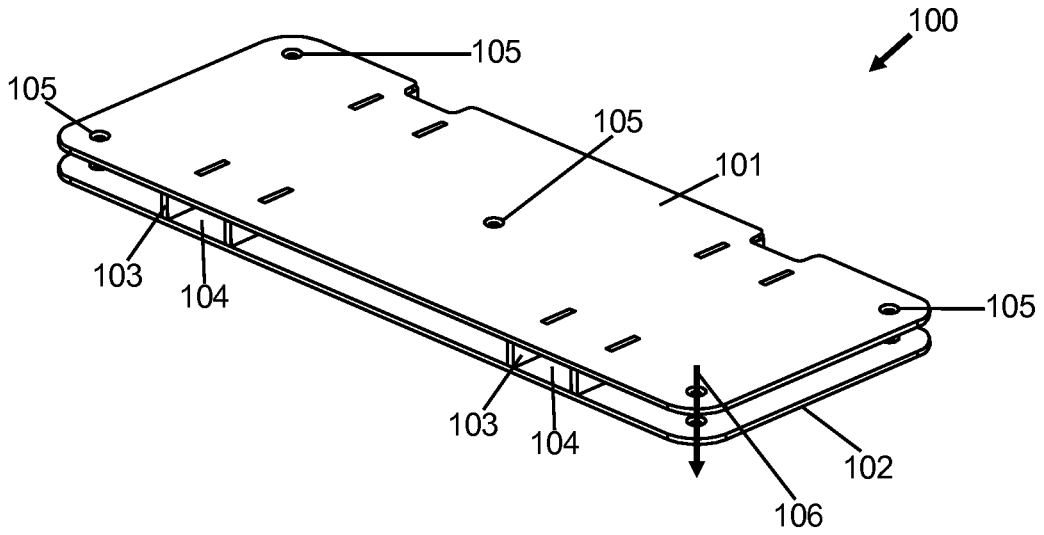

FIG. 10 is a perspective view of a base plate.

Figure 11:
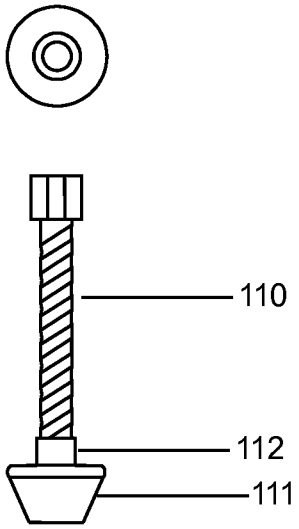

FIG. 11 is a perspective view of a foot piece arrangement for the convertible bag.

Figure 12:
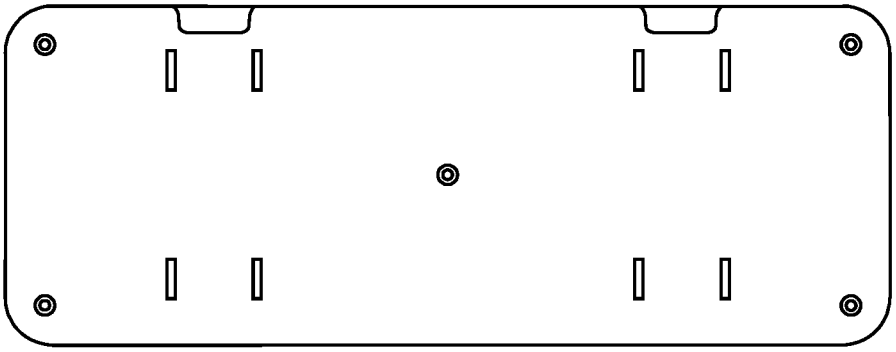

FIG. 12 illustrates a top view of the base plate.

Figure 13:
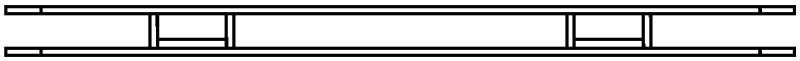

FIG. 13 illustrates a side view of the base plate.

FIGS. 14*a* to 14*e* are perspective views of a convertible bag in a handbag configuration and a backpack configuration, according to an additional embodiment of the present invention.

DETAILED DESCRIPTION

Figure 1A:
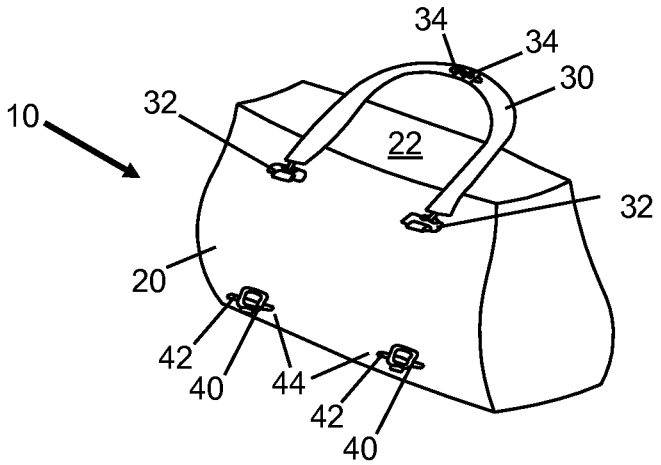
Figure 1B:
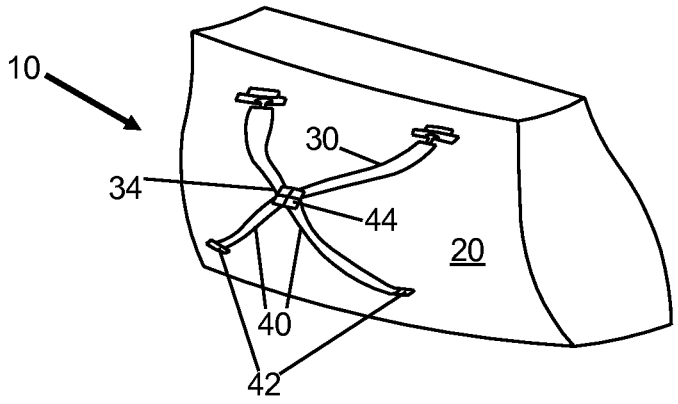

A convertible bag 10 according to a first embodiment of the present invention is shown in FIGS. 1*a* and 1*b*. In FIG. 1*a*, the convertible bag is displayed in a handbag configuration, whereas FIG. 1*b* shows the convertible bag being converted from the handbag configuration of FIG. 1*a* to a backpack configuration.

The convertible bag 10 comprises a side panel 20, which cooperates with other panels of the convertible bag 10 to form a compartment 22 within the bag for containing personal items and the like. The convertible bag comprises a handle 30, having its ends pivotally attached to the side panel 20 by connectors 32. The handle 30 is freely rotatable about the connectors 32 in the handbag configuration. There is an auxiliary handle (not shown) provided on an auxiliary side panel (not shown) opposite to the side panel 20. In use, a user may carry the bag by the handle 30, for example over one of the user's shoulders as a shoulder bag. Alternatively, the user may carry the convertible bag by hand, using both of the handle 30 and the auxiliary handle, as a handbag.

The side panel 20 further comprises two apertures 42 through which a pair of retractable straps 40 are extendable. As shown in FIG. 1*a*, the retractable straps 40 are retractable towards the side panel 20 by lockable retractor spools (not shown). The retractor spools are contained within retractor spool compartments within the bag (not shown) for applying tension to the retractable straps 40, so as to keep the retractable straps 40 in a retracted position when the convertible bag is being carried by the handle 30 in the handbag configuration. This way, the free ends of the retractable straps are secured or held against the side panel 20. This provides an elegant appearance to the bag.

Each retractable strap 40 comprises at its end a fastener or clasp 44 for preventing the retractable straps 40 from being fully retracted, through the apertures 42. As shown in FIG. 1*a*, the clasps 44 are sized larger than the apertures 42. As the retractable straps 40 retract towards the side panel 20, each of the clasps 44 abuts its respective aperture 42, so as to stop the retractable strap 40 from further retracting.

The clasps 44, protruding from the surface of the side panel 20 in the handbag configuration, can be grasped by a user to extend the retractable straps 40 when converting the bag to a backpack configuration. In the backpack configuration, the clasps 44 of the retractable straps cooperate with corresponding fasteners or handle clasps 34 on the handle 30 so as to form releasable attachments between the retractable straps 40 and the handle 30. More specifically, in order to convert the convertible bag 10 from the handbag configuration to the backpack configuration as shown in FIG. 1*b*, a user may first pull on the retractable straps by the clasps 44 to overcome the biasing force of the retractor spools and to extend the retractable straps to a suitable length, before attaching the clasps 44 to the handle clasps 34 on the handle 30. The retractor spools may be lockable to provide a desired length for each retractable strap The clasps 44 and handle clasps 34 form a releasable attachment. To convert the convertible bag 10 from the backpack configuration to the handbag configuration, the user may release the clasps 44 from the handle clasps 34 on the handle 30. Upon detaching the clasps 44 from the handle clasps 34, the tension exerted by the retractable spools reels in the straps 40 toward the apertures 42 until the clasps 44 abut the side panel.

Figure 2:
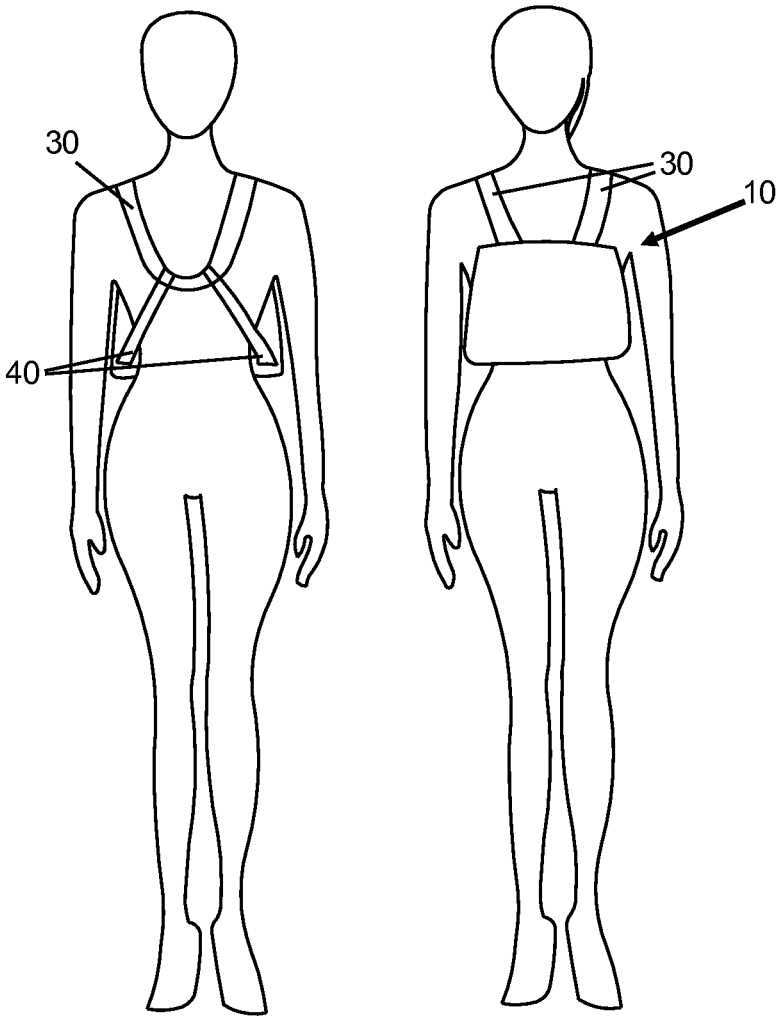
FIG. 2 is an illustration showing the convertible bag being carried by a user (in front and rear views) in the backpack configuration according to FIG. 1*b*.

FIG. 2 shows the convertible bag 10 being carried by a user in the backpack configuration. In use, the handle 30 loops over a user's neck and attaches onto the retractable straps 40. That is, the handle 30 becomes shoulder straps and a chest strap and is configured to spread the load of the convertible bag over the user's shoulders. The handle 30 and the retractable straps 40 together form backpack straps that extend across the user's chest, improving stability when the bag is carried on the user's back.

Figure 3:
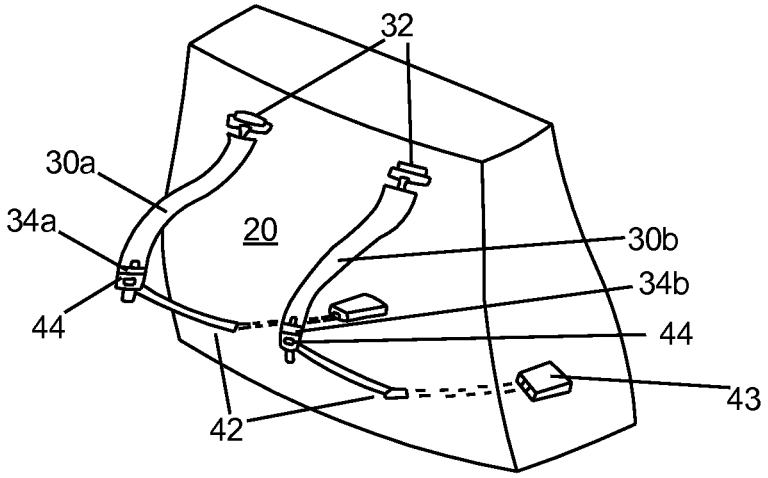
FIG. 3 is a perspective view showing the convertible bag in a backpack configuration, according to a second embodiment of the present invention.

In a second embodiment of the present invention as shown in FIG. 3, the handle clasps 34 on the handle 30 comprise two handle clasps 34*a*, 34*b* releasably attachable to each other. The handle thus comprises two handle portions 30*a*, 30*b*, each having a first end pivotally attached to the side panel 20 by a connector 32 and a second end comprising a handle clasp 34*a*, 34*b* for providing the releasable attachment. The handle 30 may thus be separated by the user into two handle portions 30*a*, 30*b* upon detaching the handle clasps 34*a*, 34*b* from each other.

FIG. 3 shows the convertible bag in its backpack configuration. Each of the handle clasps 34*a*, 34*b* is attached to a corresponding clasp 44 of retractable straps 40 to form a respective backpack strap. That is, the clasp mechanism employed in the handle clasp 34*a*, 34*b* and the clasps 44 are compatible with each other. Such a universal clasp mechanism allows the handle clasps 34*a*, 34*b* to engage with each other, as well as to cooperate with the clasps 44 of the retractable straps 40.

In order to convert the convertible bag from the handbag configuration to the backpack configuration, a user may first detach the handle clasps 34*a*, 34*b* from each other so as to split the handle 30 into handle portions 30*a*, 30*b*, before extending each of the retractable straps 40 from the side panel 20 and releasably attaching the handle clasps 34*a*, 34*b* to corresponding clasps 44 of the retractable straps 40 to form backpack straps.

To convert the convertible bag from the backpack configuration back to the handbag configuration, the user may first detach the strap clasps 44 from their corresponding handle clasps 34*a*, 34*b* so as to separate the retractable straps 40 from the handle portions 30*a*, 30*b*. The user may then attach the clasps 34*a*, 34*b* to each other to form the handle 30, whilst retracting the retractable straps 40 towards the side panel 20 using the retractor spools 43.

FIG. 4*a* and FIG. 4*b* show an embodiment of a releasable attachment being formed between the handle clasp 34*a* of the handle portion 30*a* and the clasp 44 of one of the retractable straps 40. In the illustrated example, each of the handle clasp 34*a* and the clasp 44 comprises a hook for engaging with one another. The strap clasp differs from the handle clasp by having an additional strap-length adjuster 46. In use, the user may align the hook of the handle clasp 34*a* with the hook of the strap clasp 44 before engaging them with each other to form said releasable attachment. In this example, each of the hooks comprises a pip and indent interlocking mechanism to aid alignment, as well as securing the releasable attachment during use. Magnets can also be used, additionally or as an alternative to the pip and indent interlocking mechanism. In addition, each of the clasps 44 of the retractable straps 40 is provided with a length-adjusting mechanism 46 for adjusting the length of the backpack straps.

FIGS. 5*a* and 5*b* show the clasp mechanism of the handle clasps 34*a*, 34*b* of FIGS. 4*a* and 4*b* in more detail. FIG. 5*a* shows handle clasps 34*a* and 34*b* in a secured position. As shown in FIG. 5*b*, each of the handle clasps 34*a*, 34*b* comprises a hook 70 that cooperates with a corresponding hook 70 of the other of the handle clasps 34*a*, 34*b*. The hook 70 is arranged at an acute angle to the longitudinal axis of the handle clasps 34*a*, 34*b*. Such an arrangement helps prevent accidental disengagement of the handle clasps 34*a*, 34*b* during use. Furthermore, corresponding pips and indents 72 are formed on inter-engaging surfaces each of the hooks 70 such that in use, the pips and indents lock the hooks 70 in place. Magnets can also be used, additionally or as an alternative to the pip and indent interlocking mechanism This eliminates relative rotation between the handle clasps 34*a*, 34*b*, thus preventing accidental disengagement of the handle clasps 34*a*, 34*b* due to twisting in the straps.

To form a releasable attachment in handle clasps 34*a*, 34*b*, the user may first align the clasps by inserting the hook 70 of each of the clasps 34*a*, 34*b* into an orifice 74 defined in the other of the clasps 34*a*, 34*b*, before urging the clasps 34*a*, 34*b* away from each other in a longitudinal direction. This allows the pips and indents at the surface of the hooks 70 to lock onto each other so as to secure the releasable attachment in the clasps 34*a*, 34*b*.

To decouple the handle clasps 34*a*, 34*b* from each other, the user may push the clasps 34*a*, 34*b* towards each other in the longitudinal direction. Doing so disengages the pips and indents connection between the hooks 70 and thereby allows the handle clasps 34*a*, 34*b* to be released from each other.

It is evident that the two clasps, shown in FIG. 5*b*, are identical, so can be manufactured as a single item of manufacture for use as the first and second claps of the clasp mechanism, and hence reduce tooling costs.

Figure 9A:
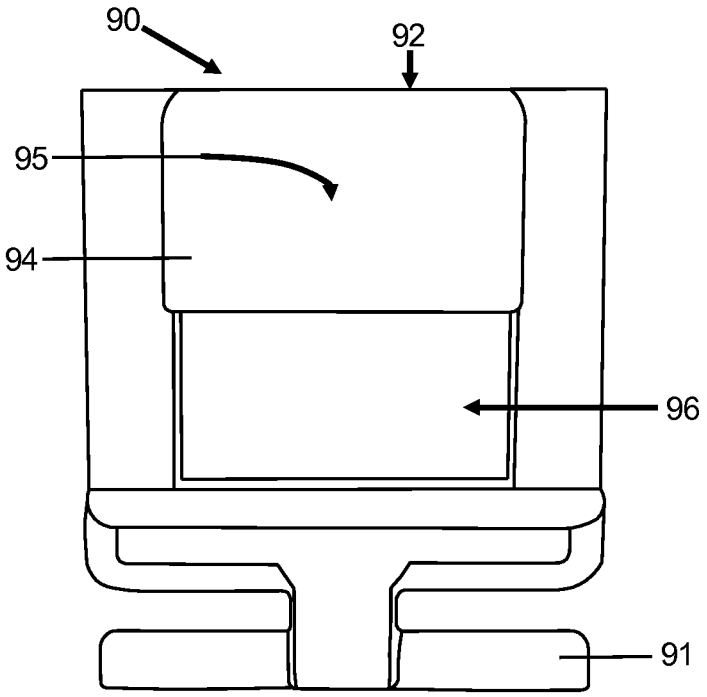
Figure 9B:
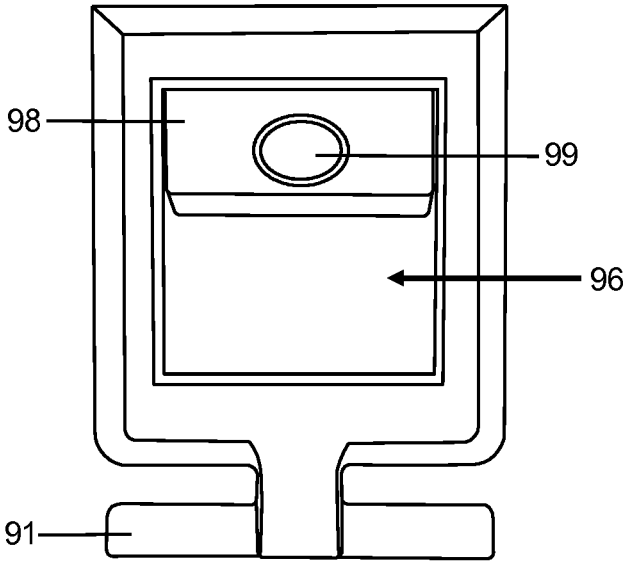
Figure 9C:
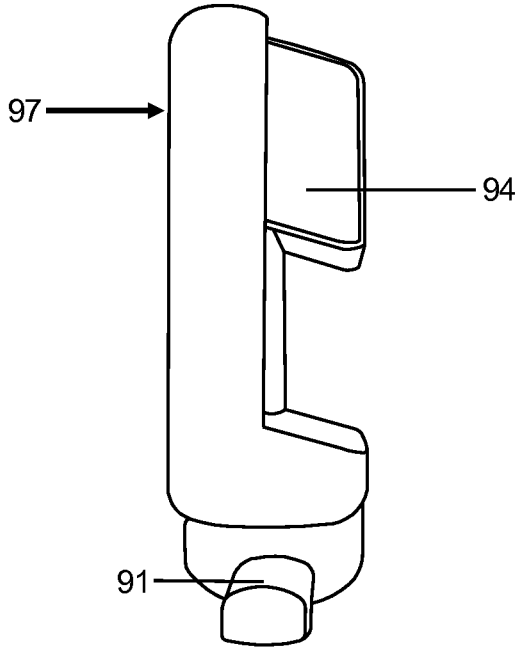
Figure 9D:
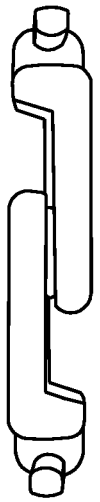

In a variation of the clasps and clasp mechanism shown in FIGS. 5*a* and 5*b*, the hook may have a return that does not occupy the full thickness of the fastening, as shown in FIGS. 9*a* to 9*c*. Here, the hook consists of a proximal portion on a lateral portion of the hooked clasp and a distal portion, comprising a return, on the central portion of the hooked clasp, whereby the lateral portion and the distal portion are laterally separated. When viewed as in FIG. 9*b*, there is no overlap between the proximal and distal portions. It is therefore made possible to slide one return past the other as though they were parts of hooks angled at zero degrees because the hook is not configured in a single plane but has lateral and central portions. The overlap achieved makes for a more secure attachment than that of FIGS. 5*a* and 5*b*. When two such clasps are attached, the resulting fastening is shown in FIG. 9*d*.

Thus, the hooked clasp 90 has a bar directed transverse to the longitudinal direction of the hooked clasp, which serves as strap attachment means 91, and hook 92 with a return 94. The return has an outer surface 95, which upon attachment to another hooked clasp may conveniently align with an opposite surface 97 of the other hooked clasp. In order to get to this position, the return 94 of the hook is passed through an orifice 96 and then slid behind the return of the other hooked clasp until it reaches the position shown in FIG. 9*d*.

The return 94 has an inner side 98 into which is embedded a magnet 99. The magnet may be inserted after manufacture of the remainder of the clasp, for example by press-fitting. Two sets of clasps would be made with opposite polarities at the inner surface of the returns of the clasps. Alternatively, a compact bar magnet which presents both polarities in the same direction may be incorporated to expose those polarities on the inner surface of the return, in such a way that the polarity changes in a distal direction along the return. When the fastener is attached, the opposite orientation of the fasteners causes opposite polarities to align, thereby providing an attractive force and so allowing one type of hooked clasp to be used for both parts of the fastener.

Conventional fasteners have clasps that deform elastically before engaging and need to be squeezed to disengage the clasps.

The hooked clasps may be employed in the fastener used in the handle 30 or for the straps 40 of bags in this disclosure.

FIGS. 6*a* and 6*b* show the releasable attachment formed between a handle clasp 34 and a clasp 44 of the retractable strap 40. The same clasp mechanism as shown in FIGS. 5*a* and 5*b* is applied to effect said releasable attachment. The clasp 44 is additionally provided with a length-adjusting mechanism 46 for adjusting the length of the backpack straps. In this example, the length-adjusting mechanism 46 comprises a pair of corresponding webbing teeth. As shown in FIG. 6*b*, the retractable strap 40 slides through a gap between the webbing teeth so as to permit length adjustment in the backpack strap. In use, the tension in the retractable strap 40 forces webbing teeth to grip onto the strap 40, and thereby stops the strap 40 from sliding through the gap between the webbing teeth.

In the embodiment shown in FIG. 3, the backpack straps formed from the handle portions 30*a*, 30*b* and the retractable straps 40 are approximately parallel to each other, such that each of the backpack straps loops over one of the user's shoulders. However, in a third embodiment according to the present invention (not shown in the drawings), the handle clasps 34*a*, 34*b* of the handle 30 and the clasps 44 of the retractable straps 40 may all attach onto a central hub such that the backpack straps extend across the user's chest in a manner similar to the convertible bag shown in FIG. 1*b*. In this case, because the handle is configured to split into handle portions 30*a*, 30*b*, there is no need to loop the handle 30 over the user's neck before attaching the handles 30 onto the retractable straps 40. Instead, the user may opt to put on the convertible bag by the backpack straps before clipping the two backpack straps to each other at the central hub. This way, the convertible bag may be carried with added stability without requiring the user to pass his/her head through the handle 30 as required in the embodiment shown in FIG. 2.

FIGS. 7*a* and 7*b* respectively show a convertible bag in a handbag configuration and a backpack configuration according to a fourth embodiment of the present invention. In FIGS. 7*a* and 7*b* the convertible bag is viewed from an opposite direction to that of FIGS. 1 and 3, in order to display the auxiliary handle, whilst the portion of the backpack straps are hidden from view on the opposite side of the bag. FIG. 7*c* illustrates the internal components of the bag of FIGS. 7*a* and 7*b*, rotated through 180° such that the auxiliary handle 50 and the auxiliary side panel 24 are on the far side instead of the near side of the bag, in a perspective cut-away view viewed from the same angle (i.e. viewed from above and to the right) as that shown in FIGS. 7*a* and 7*b*. FIG. 7*d* illustrates a cross-sectional view of the bag of FIGS. 7*a* and 7*b*.

In FIG. 7*a*, the convertible bag 10 is shown having an auxiliary handle 50 extending through a set of auxiliary-handle apertures 52 in an auxiliary side panel 24, wherein said auxiliary side panel 24 is opposite to the side panel 20 with the compartment formed therebetween. In this embodiment the convertible bag 10 does not rely on retractable spools for tensioning the retractable straps 40. Instead, the two ends of the auxiliary handle 50 extend through both the auxiliary side panel 24 and the side panel 20 to form the retractable straps 40 at the side panel 20 as shown in FIGS. 7*c* and 7*d*. In other words, the auxiliary handle 50 is formed integrally with the retractable straps 40. The retractable straps 40 pass within passageways between a side member 62 and the auxiliary side panel 24, and between a floor member 60 and a floor panel 64. Such arrangement allows the retractable straps 40 to freely slide through the apertures 42 and the auxiliary-handle apertures 52, and yet they do not come in contact with items placed in the compartment 22.

Optionally, a base plate 100, as shown in FIG. 10, is provided within the passageways between the floor member 60 and the floor panel 64. Such an assembly of the base plate comprises a top plate 101, a bottom plate 102 and a plurality of vertical walls 103 that form the channels 104 through the top plate 101 and the bottom plate 102. Holes 105, one at each corner and one in center of both the top plate 101 and the bottom plate 102, are drilled. A shaft 106 passes through a hole 105 with the top plate placed above the bottom plate. A bolt 110, as shown in FIG. 11, passes through the shaft and pierces the bottom of the convertible bag 10 to tighten a foot piece 111. The foot piece 111 is placed outside the convertible bag 10, wherein the foot piece 111 comprises a nut 112 at its top. The bolt 110, passing through the shaft 106, tightens with the nut 112 fixed at the top of the foot piece 111. Foot pieces are tightened, below each hole of the base plate, outside the bag in order to ensure that the base plate is fixed with the floor member 60 and the floor panel 64. Towards the back of the side panel 20 and the auxiliary side panel 24, there is a horizontal wall piece in each channel. The wall pieces form chambers that are large enough to accommodate the clasps 44.

FIG. 12 illustrates top view of the base plate 100 and FIG. 13 illustrates side view of the base plate 100.

The assembly of the base plate 100 is provided with the set of channels 104 for allowing the retractable straps 40 to freely slide through the passageways between the set of auxiliary-handle apertures 52 in the auxiliary side panel 24 and the apertures 42 in the side panel 20. A roller (not shown in figure) is provided at opening of each channel to facilitate movement of retractable straps through the channels. The channels make the movement of straps easy for the user. Moreover, the use of rollers at the opening of each channel further reduces the effort of the user in stretching the retractable straps from the set of auxiliary-handle apertures 52 in the auxiliary side panel 24 to the apertures 42 in the side panel 20.

The width of each of the channels is such that it allows the easy movement of the retractable straps through the base plate but blocks the clasps 44 from travelling from the apertures 42 in the side panel 20 towards the set of auxiliary-handle apertures 52.

In the handbag configuration as shown in FIG. 7*a*, the user may carry the convertible bag using the auxiliary handle 50. This extends the auxiliary handle 50 from the auxiliary side panel 24 through the auxiliary-handle apertures 52 and in the process, causes the retractable straps 40 to retract towards the side panel 20. During use, the tension in the weight-bearing auxiliary handle ensures the clasps 44 of the retractable straps 40 are securely held against the apertures in 42 in side panel 20. More specifically, the tension in the retractable straps 40 is supplied by the load carrying auxiliary handle 42, in contrast to the retractor spools in the embodiment as shown in FIGS. 1 and 3.

To convert the convertible bag from the handbag configuration of FIG. 7*a* to the backpack configuration of FIG. 7*b*, a user may pull on and extend the retractable straps 40 at the side panel 20, in a manner similar to that as described in the previous embodiments. This causes the auxiliary handle 50 to retract towards the auxiliary side panel 24 and the auxiliary-handle apertures 52 as shown in FIG. 7*b*, consequently providing additional length in the retractable straps 40. The user may then attach the extended retractable straps 40 to the handle 30 to form backpack straps with the use of clasps 34, 44. In use, the weight of the bag tensions the backpack straps, which in turn biases the auxiliary handle 50 against the auxiliary side panel 24 to secure the auxiliary handle 50 thereto. Such arrangement shortens the auxiliary handle 50 and thus minimises its free movement in the backpack configuration.

A user may convert the convertible bag from the backpack configuration back to the handbag configuration by detaching the retractable straps 40 from the handle 30 to free up the retractable straps 40, before pulling on the auxiliary handle 50 at the auxiliary side panel 24 in order to extend said auxiliary handle 50 until the clasps 44 at the ends of the retractable straps abut the apertures 42 in the side panel 20.

FIGS. 8*a* and 8*b* are respectively a front view and a back view of a convertible bag in the backpack configuration according to a fifth embodiment of the present invention. This embodiment differs to the example shown in FIGS. 7*a*-7*d*, in that the auxiliary handle 50 comprises two auxiliary handle portions each comprising an auxiliary handle clasp 54*a*, 54*b*. In the handbag configuration, the auxiliary handle clasps 54*a*, 54*b* cooperate with each to other to form the auxiliary handle. To convert the bag from the handbag configuration to the backpack configuration, a user may separate the two auxiliary handle portions by detaching the auxiliary handle clasps 54*a*, 54*b* from each other, before pulling on and extending the retractable straps 40 from the side panel 20 until the auxiliary handle clasps 54*a*, 54*b* abut the auxiliary side panel 24 as shown in FIG. 8*a*. This allows an additional length of the retractable straps 40 to be extended from the side panel 20 for attaching to the handle clasps 34*a*, 34*b*.

In comparison to the embodiment shown in FIGS. 7*a-c*, the use of detachable auxiliary handle portions as shown in FIGS. 8*a* and 8*b* permits shorter retractable straps 40 to be used. Furthermore, the auxiliary handle 50 is disassembled and stowed away in the backpack configuration, eliminating any chance of it getting caught when the user is carrying the convertible bag in the backpack configuration.

To convert the convertible bag from the backpack configuration to the handbag configuration, a user may detach the retractable straps 40 from the handle 30 in order to free up the retractable straps 40, before pulling on the auxiliary handle clasps 54*a*, 54*b* at the auxiliary side panel 24 to extend said auxiliary handle clasps 54*a*, 54*b* until the clasps 44 of the retractable straps 40 abut the apertures 42 in the side panel 20. The user may then attach the auxiliary handle clasps 54*a*, 54*b* with each other to form the auxiliary handle 50.

Figure 14A:
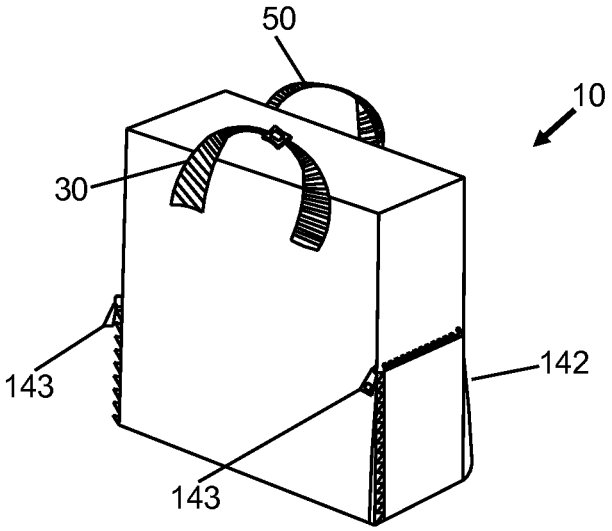
Figure 14B:
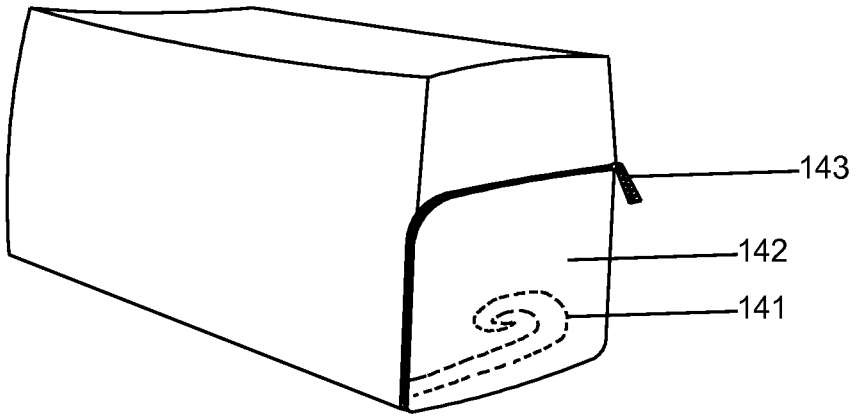
Figure 14C:
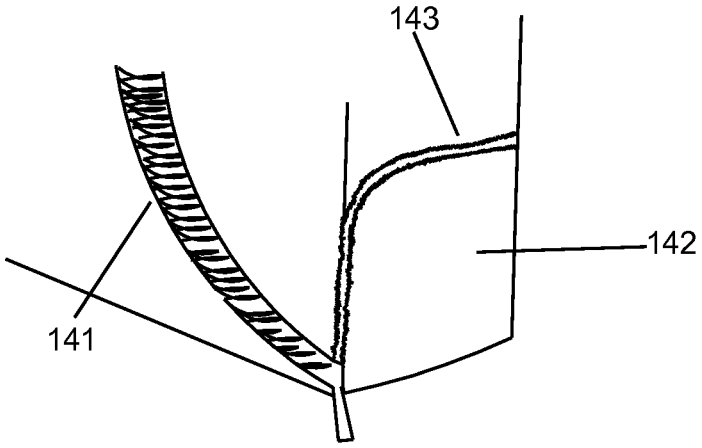

In an embodiment shown in FIG. 14*a*-14*e*, secondary straps 141 are provided in zipped pockets 142. This embodiment can be used in addition to the above embodiments, as well as independently, as a design feature in order to improve the functionality of the convertible bag 10. FIG. 14*a* shows the zipped pockets 142 provided for the secondary straps 141. The secondary straps 141 rest inside the zipped pockets 142. FIG. 14*b* shows the secondary straps 141 being folded and packed in a zip arrangement 143. A zip of the zip arrangement 143 is operable to open and close the zip pockets 142 to release and pack the secondary straps, respectively. The secondary straps 141 are provided with clasps 144 for forming releasable attachments between the secondary straps 141 and the handle 30. FIG. 14*c* shows the secondary straps 141 connected at the sides of the convertible bag 10. The secondary straps 141, connected at the sides of the convertible bag 10, are sewn in to side walls of the convertible bag 10 to make the secondary straps more durable. Sewing the secondary straps to the side walls of the convertible bag 10 enables the user to carry more load in the bag without having the risk of the secondary straps being broken down due to heavy load.

Figure 14D:
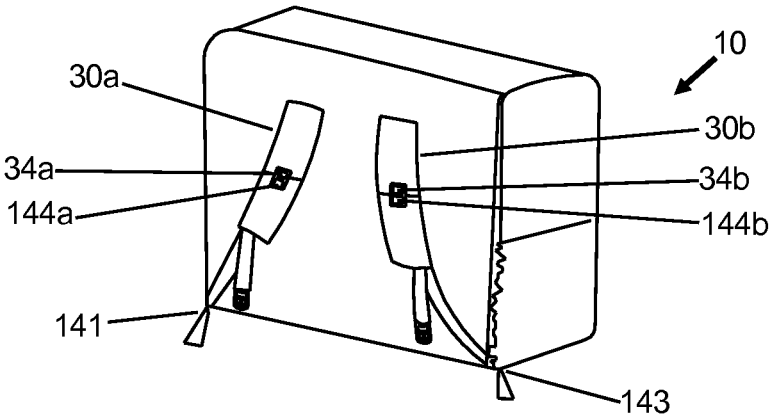

To convert the convertible bag 10 from the handbag configuration to the backpack configuration, the user may first open zips of the zip arrangement 143 in order to release the secondary straps 141 from the zipped pockets 142. FIG. 14*d* shows the steps, further employed, for converting the convertible bag from the handbag configuration to the backpack configuration. The user may first detach the handle clasps 34*a* and 34*b* from each other so as to split the handle 30 into handle portions 30*a* and 30*b*, before unfolding and extending the secondary straps 141 from the zipped pockets 142 and releasably attaching the handle clasps 34*a* and 34*b* to corresponding clasps 144*a* and 144*b*, respectively, of the secondary straps 141 to form backpack straps.

Optionally, each of the secondary straps 141 comprises a strap-length adjuster, configured to vary the length of the respective backpack strap in the backpack configuration. The strap-length adjusters may be webbing strap adjusters, buckles, winders or any other suitable adjusters. The adjustment of length of the backpack strap is advantageous as it enables the convertible bag to be used, by different users having different heights and shoulder size, in backpack configuration. FIGS. 6*a* and 6*b* shows the detailed illustrations of the length adjustment mechanism.

The user may convert the convertible bag from the backpack configuration back to the handbag configuration by detaching the secondary straps 141 from the handle 30 to free up the secondary straps 141, before pulling on the auxiliary handle 50 at the auxiliary side panel 24. The secondary straps 141 are folded back and packed in the zip pockets 142, and the zips of the zip arrangement 143 are closed.

Figure 14E:
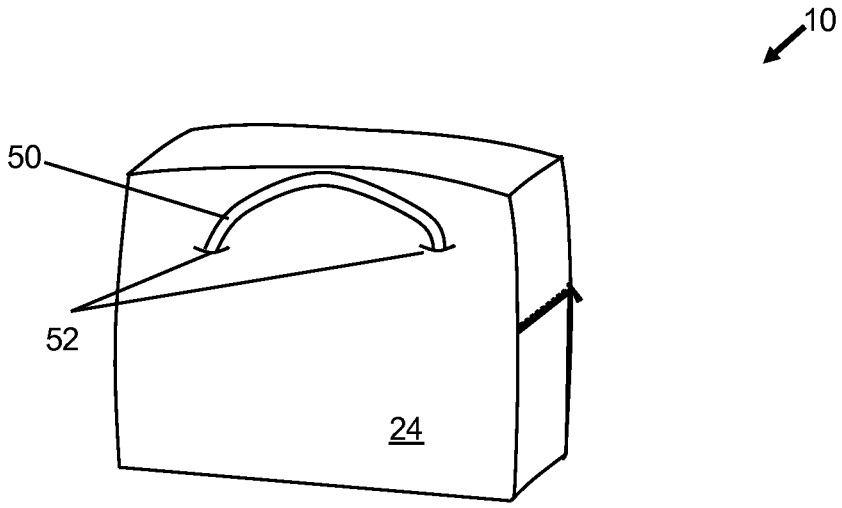

FIG. 14*e* shows an optional arrangement for hiding the auxiliary handle 50 in the auxiliary side panel 24 of the convertible bag when the convertible bag is used in the backpack configuration. In FIG. 14*e*, the convertible bag is viewed from an opposite direction to that of FIG. 14*a*, in order to display the auxiliary handle, whilst the portion of the backpack straps are hidden from view on the opposite side of the bag. In FIG. 14*e*, the convertible bag 10 is shown having an auxiliary handle 50 partly hidden in an auxiliary side panel 24, by insertion through auxiliary handle apertures 52, wherein said auxiliary side panel 24 is opposite to the side panel 20 with the compartment formed therebetween.

The invention claimed is:

1. A convertible bag comprising:

a handle;

two retractable straps, wherein each retractable strap is extendable from the bag and releasably attachable to the handle, so as to convert the convertible bag from a handbag configuration in which the bag may be carried using the handle, to a backpack configuration in which the bag may be carried using backpack straps formed from the handle and the retractable straps, and wherein each retractable strap is releasable from the handle and retractable, so as to convert the convertible bag from the backpack configuration to the handbag configuration, wherein the retractable straps are extendable and retractable through an aperture, or apertures, in the convertible bag, and wherein the handle comprises two handle portions, wherein in the handbag configuration the two handle portions are releasably attached to each other to form said handle, and wherein in the backpack configuration each of the handle portions is releasably attached to the corresponding retractable straps to form the backpack straps; and an auxiliary handle configured such that the bag in its handbag configuration may be carried using both the handle and the auxiliary handle, wherein the extension of the retractable straps to convert the convertible bag from the handbag configuration to the backpack configuration draws the auxiliary handle towards the auxiliary apertures, and wherein extension of the auxiliary handle from the convertible bag to convert the convertible bag from the backpack configuration to the handbag configuration retracts the retractable straps.

2. The convertible bag according to claim 1, wherein each of the handle portions and the retractable straps comprises a fastener for effecting said releasable attachment, and wherein fasteners of the handle portions are configured to cooperate with each other in the handbag configuration, or with the fasteners of the retractable straps in the backpack configuration.

3. The convertible bag according to claim 1, wherein in the handbag configuration the retractable straps are securely retracted and at least a portion of each strap is hidden within the bag.

4. The convertible bag according to claim 1, wherein the retractable straps extend through an auxiliary aperture, or auxiliary apertures, in the bag and are connected to the auxiliary handle.

5. The convertible bag according to claim 1, wherein each retractable strap is configured to slide within a passage defined within the convertible bag.

6. The convertible bag according to claim 1, wherein the backpack straps are separate to each other in the backpack configuration and wherein in use, each of the backpack straps is configured to pass over a user's shoulder.

7. The convertible bag according to claim 1, wherein each of the retractable straps comprises an adjuster, wherein the adjuster is configured to vary length of the respective backpack straps formed in the backpack configuration.

8. The convertible bag according to claim 1, wherein the auxiliary handle comprises two auxiliary handle portions releasably attached to each other.

9. The convertible bag according to claim 8, wherein the two auxiliary handle portions are detachable from each other, on converting the convertible bag from the handbag configuration to the backpack configuration; and wherein the two auxiliary handle portions are releasably attached to each other to form the auxiliary handle, on converting the convertible bag from the backpack configuration to the handbag configuration.

* * * * *